US009698482B2

(12) United States Patent
Sasaki et al.

(10) Patent No.: US 9,698,482 B2
(45) Date of Patent: Jul. 4, 2017

(54) ANTENNA DEVICE

(71) Applicant: Kabushiki Kaisha Toshiba, Minato-ku (JP)

(72) Inventors: Tadahiro Sasaki, Nerima-ku (JP); Kazuhiko Itaya, Yokohama (JP); Hiroshi Yamada, Yokohama (JP); Yutaka Onozuka, Yokohama (JP); Nobuto Managaki, Kawasaki (JP); Atsuko Iida, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 122 days.

(21) Appl. No.: 14/332,781

(22) Filed: Jul. 16, 2014

(65) Prior Publication Data

US 2015/0022416 A1 Jan. 22, 2015

(30) Foreign Application Priority Data

Jul. 19, 2013 (JP) ..... 2013-151080

(51) Int. Cl.

| | |
|---|---|
| ***H01Q 1/52*** | (2006.01) |
| ***H01Q 9/04*** | (2006.01) |
| ***H01Q 15/00*** | (2006.01) |
| ***H01Q 23/00*** | (2006.01) |

(52) U.S. Cl.

CPC ..... *H01Q 9/0407* (2013.01); *H01Q 15/008* (2013.01); *H01Q 23/00* (2013.01)

(58) Field of Classification Search

CPC .... H01Q 9/0407; H01Q 15/008; H01Q 23/00; H01Q 1/526

See application file for complete search history.

(56) References Cited

U.S. PATENT DOCUMENTS 5,050,238 A * 9/1991 Tomizuka ..... H01L 23/5286 257/659
5,928,076 A 7/1999 Clements et al.
2008/0129511 A1 6/2008 Yuen et al.
(Continued)

FOREIGN PATENT DOCUMENTS

JP 5-121913 5/1993
JP 5-144994 6/1993
(Continued)

*Primary Examiner* — Dieu H Duong
*Assistant Examiner* — Noel Maldonado
(74) *Attorney, Agent, or Firm* — Oblon, McClelland, Maier & Neustadt, L.L.P.

(57) ABSTRACT

An antenna device of the present embodiment includes: a first conductive layer connected to a ground potential, a semiconductor device provided above the first conductive layer, a second conductive layer provided above the semiconductor device, a first via connecting the second conductive layer and the first conductive layer, a third conductive layer provided above the second conductive layer, a second via passing through the first opening, and an antenna provided above the third conductive layer. A dielectric is provided between the second conductive layer and the semiconductor device, between the third conductive layer and the second conductive layer, and between the antenna and the third conductive layer. The second conductive layer includes a first opening. The second via connects the third conductive layer and the first conductive layer.

10 Claims, 6 Drawing Sheets

(56) References Cited

U.S. PATENT DOCUMENTS

| | | | | |
|---|---|---|---|---|
| 2010/0053013 | A1* | 3/2010 | Konishi | H01F 10/20 343/772 |
| 2010/0084176 | A1* | 4/2010 | Kim | H05K 1/0236 174/261 |
| 2010/0108373 | A1 | 5/2010 | Park | |
| 2012/0274523 | A1* | 11/2012 | Ayatollahi | H01Q 1/243 343/745 |
| 2012/0325523 | A1* | 12/2012 | Kobayashi | H01Q 15/008 174/251 |
| 2013/0256009 | A1 | 10/2013 | Sasaki et al. | |
| 2014/0029227 | A1 | 1/2014 | Sasaki et al. | |

FOREIGN PATENT DOCUMENTS

| | | | |
|---|---|---|---|
| JP | 5-152455 | | 6/1993 |
| JP | 5-166957 | | 7/1993 |
| JP | 6-112352 | | 4/1994 |
| JP | 11-17063 | | 1/1999 |
| JP | 11-163568 | | 6/1999 |
| JP | 11-214580 | | 8/1999 |
| JP | 2002-124592 | | 4/2002 |
| JP | 2003-133462 | | 5/2003 |
| JP | 2004-165560 | | 6/2004 |
| JP | 2005-45758 | A | 2/2005 |
| JP | 2009-218970 | | 9/2009 |
| JP | 2010-016554 | A | 1/2010 |
| JP | 2010-238692 | A | 10/2010 |
| JP | 2012-49618 | | 3/2012 |
| JP | 2013-207621 | | 10/2013 |
| JP | 2014-27180 | | 2/2014 |
| WO | WO 2007/049376 | A1 | 5/2007 |
| WO | WO 2007/049382 | A1 | 5/2007 |
| WO | 2011/111297 | A1 | 9/2011 |

* cited by examiner

ANTENNA DEVICE

CROSS-REFERENCE TO RELATED APPLICATION

This application is based upon and claims the benefit of priority from Japanese Patent Application No. 2013-151080, filed on Jul. 19, 2013, the entire contents of which are incorporated herein by reference.

FIELD

Embodiments described herein relate generally to an antenna device.

BACKGROUND

In systems with communication functions, antennas for transmitting and receiving radio waves are required.

In such cases, an antenna can be housed within a system casing together with other functions of the system, or can be provided outside of the system casing. In order to reduce the size of a system, it is preferable for the antenna to be stored within the system casing.

If the antenna is housed within the system casing, there are two significant problems. The first problem is reducing the size of the antenna. The second problem is protecting the electronic circuits of the system from electromagnetic waves emitted from the antenna.

The size of the antenna depends on the frequency of the radio waves which are transmitted and received by the antenna. Thus, if the frequency is low, it is difficult to reduce the size of the antenna. On the other hand, if the frequency is relatively high, for example, in the case of a high frequency of 100 MHz or more, the required antenna size becomes smaller. Consequently, the possibility of the antenna to be housed within the system casing increases, and it is thought that the first problem can be solved.

Thus, it becomes important to protect the electronic circuits from the electromagnetic waves emitted from the antenna, which is the second problem. In other words, it becomes important to suppress a malfunction of the electronic circuits because of the electromagnetic waves emitted from the antenna.

DETAILED DESCRIPTION

An antenna device of an embodiment including: a first conductive layer connected to a ground potential; a semiconductor device provided above the first conductive layer; a second conductive layer provided above the semiconductor device, a dielectric provided between the second conductive layer and the semiconductor device, the second conductive layer including a first opening; a first via connecting the second conductive layer and the first conductive layer; a third conductive layer provided above the second conductive layer, a dielectric provided between the third conductive layer and the second conductive layer; a second via passing through the first opening, the second via connecting the third conductive layer and the first conductive layer; and an antenna provided above the third conductive layer, a dielectric provided between the antenna and the third conductive layer.

In the present description, the word "above" is used to indicate the relative positional relationship between the constituent elements, and does not necessarily mean "up" based upon the direction of gravity.

(First Embodiment)

An antenna device of the present embodiment including: a first conductive layer connected to a ground potential; a semiconductor device provided above the first conductive layer; a second conductive layer provided above the semiconductor device, a dielectric provided between the second conductive layer and the semiconductor device, the second conductive layer including a first opening; a first via connecting the second conductive layer and the first conductive layer; a third conductive layer provided above the second conductive layer, a dielectric provided between the third conductive layer and the second conductive layer; a second via passing through the first opening, the second via connecting the third conductive layer and the first conductive layer; and an antenna provided above the third conductive layer, a dielectric provided between the antenna and the third conductive layer.

Figure 1:
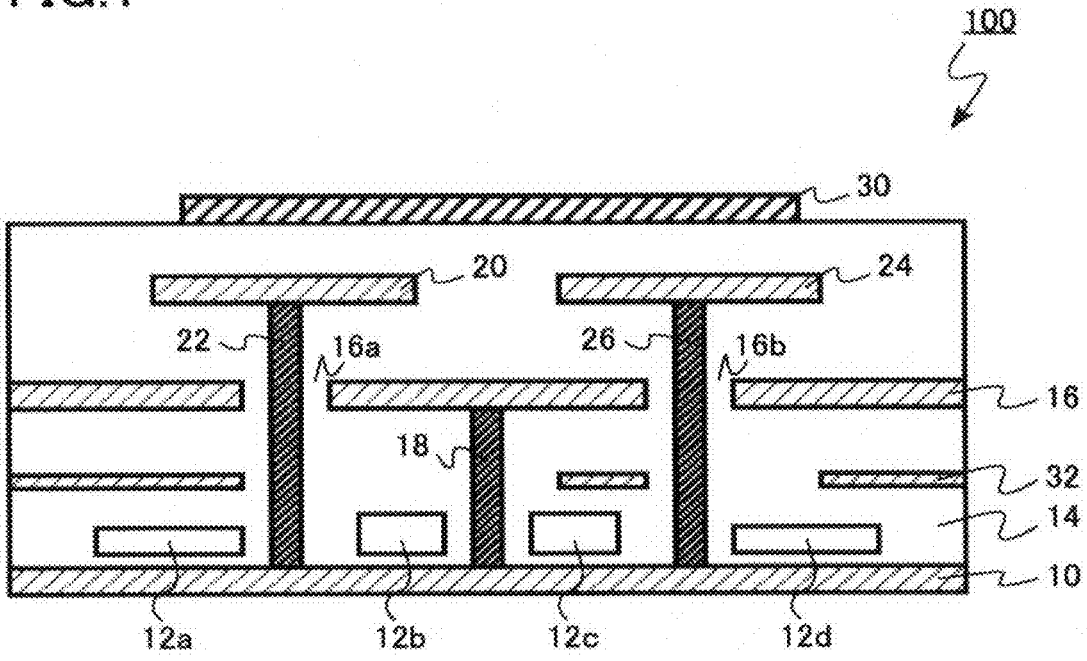
FIG. 1 is a schematic cross-sectional view of an antenna device of a first embodiment.
Figure 2:
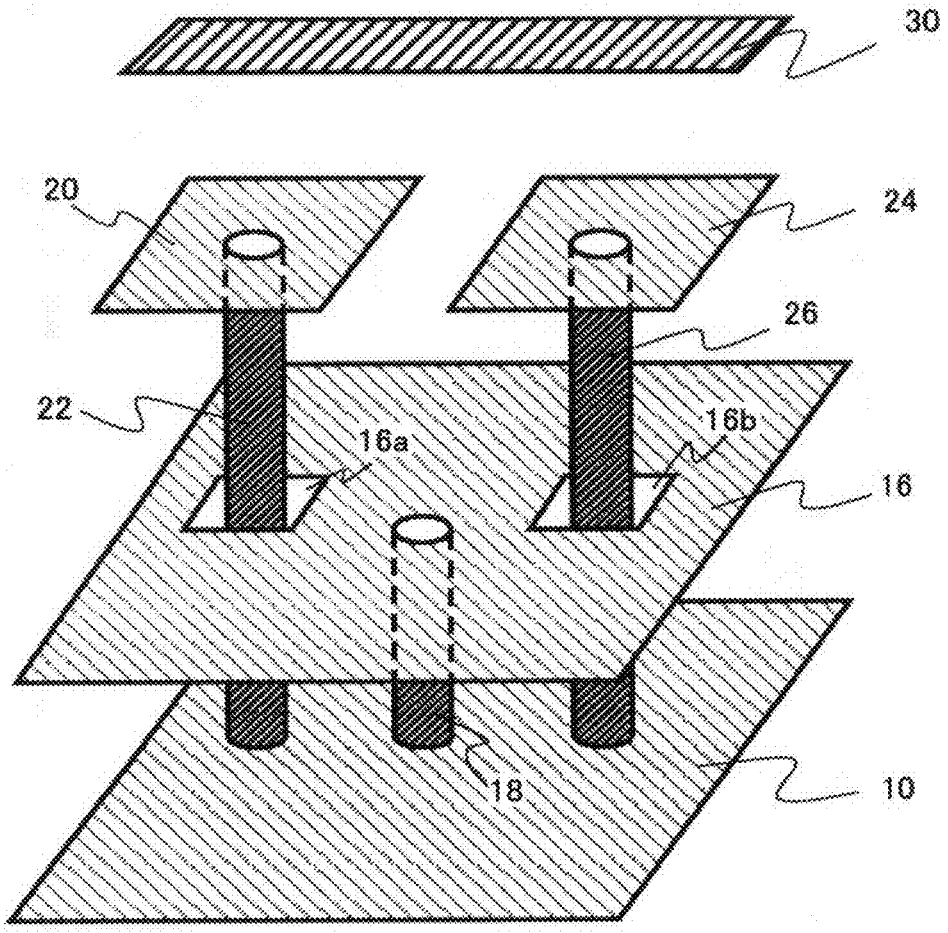
FIG. 2 is a perspective conceptual view depicting only the main conductor portion of the antenna device of the first embodiment.

FIG. 1 is a schematic cross-sectional view of the antenna device of the present embodiment. FIG. 2 is a perspective conceptual view depicting only the main conductor portion of the antenna device of the present embodiment.

The antenna device of the present embodiment is, for example, a wireless communication device whose operating frequency is between 400 MHz and 1 GHz. The size thereof is, for example, several millimeters squared.

The antenna device of the present embodiment is provided with a first conductive layer 10 that is connected to the ground potential, and semiconductor devices 12*a*, 12*b*, 12*c*, and 12*d* that are provided above the first conductive layer. The antenna device is also provided with a second conductive layer 16 that is provided above the semiconductor devices 12*a*, 12*b*, 12*c*, and 12*d*, and a first via 18 that connects the second conductive layer 16 and the first conductive layer 10. A dielectric 14 is provided between the second conductive layer 16 and the semiconductor devices 12*a*, 12*b*, 12*c*, and 12*d*.

The antenna device is also provided with a third conductive layer 20 that is provided above the second conductive layer 16, and a second via 22 that connects the third conductive layer 20 and the first conductive layer 10. The second via 22 passes through a first opening 16*a* that is provided in the second conductive layer 16. The dielectric 14 is provided between the third conductive layer 20 and the second conductive layer 16.

The antenna device is also provided with a fourth conductive layer 24 that is provided above the second conductive layer 16, and a third via 26 that connects the fourth conductive layer 24 and the first conductive layer 10. The second conductive layer 16 has a second opening 16*b*, and the third via 26 passes through the second opening 16*b*. The dielectric 14 is provided between the fourth conductive layer 24 and the second conductive layer 16.

In addition, the antenna device is provided with an antenna 30 that is provided above the third conductive layer 20. The dielectric 14 is provided between the antenna and the third conductive layer 20. Furthermore, the antenna device is provided with, between the first conductive layer 10 and the second conductive layer 16, a fifth conductive layer 32 that is electrically connected to the semiconductor devices 12*a*, 12*b*, 12*c*, and 12*d* by means of a conductor that is not depicted.

The first conductive layer 10, the second conductive layer 16, the third conductive layer 20, the fourth conductive layer 24, and the fifth conductive layer 32 are, for example, a metal, and are, for example, gold (Au) or copper (Cu).

The first via 18 and the second via 22 are, for example, a metal, and are, for example, gold (Au) or copper (Cu).

The dielectric 14 is, for example, a resin. The dielectric 14 may be, for example, an oxide film such as a silicon oxide film, or may be a ceramic. The dielectric 14 may have laminated structure formed with multiple layers.

The semiconductor devices 12*a*, 12*b*, 12*c*, and 12*d* make up a signal processing circuit that carries out transmission and reception processing for the antenna device 100. The semiconductor devices 12*a*, 12*b*, 12*c*, and 12*d* may be bare chips or may be mounted chips.

The fifth conductive layer 32 is, for example, a signal line. The fifth conductive layer 32 is, for example, electrically connected to the semiconductor devices 12*a*, 12*b*, 12*c*, and 12*d*. The connections for each of the semiconductor devices 12*a*, 12*b*, 12*c*, and 12*d* and the input/output transmission of signals with the outside are, for example, carried out using the signal line formed by the fifth conductive layer 32.

The antenna device of the present embodiment, for example, is able to be manufactured by means of a method in which a plurality of semiconductor chips are adhered with resin and the chips are connected to each other with a wiring layer, which is referred to as a pseudo-system on a chip (pseudo-SOC).

The first conductive layer 10, for example, covers the entirety of the rear surface of the antenna device 100, and is fixed to the ground potential. The second conductive layer 16 is, for example, a rectangular metal patch. A first electromagnetic band gap (EBG) structure including what is referred to as a mushroom structure is formed by the second conductive layer 16 and the first via 18.

Furthermore, the third conductive layer 20 and the fourth conductive layer 24 are, for example, rectangular metal patches. The third conductive layer 20 and second via 22, and the fourth conductive layer 24 and third via 26 form a mushroom structure, respectively. These mushroom structures form a second EBG structure.

The metal patch of the first EBG structure and the metal patches of the second EBG structure are not directly connected. The metal patch of the first EBG structure and the metal patches of the second EBG structure are connected by way of the first via 18, the first conductive layer 10, and the second via 22, or they are connected by way of the first via 18, the first conductive layer 10, and the third via 26. The first EBG structure and the second EBG structure form three-dimensional capacitance and three-dimensional inductance.

This three-dimensional capacitance and three-dimensional inductance function as a filter. The negative effect that electromagnetic waves radiated from the antenna 30 have on the signal processing circuit (electronic circuit) configured from the semiconductor devices 12*a*, 12*b*, 12*c*, and 12*d* and so forth is suppressed.

Figure 3A:
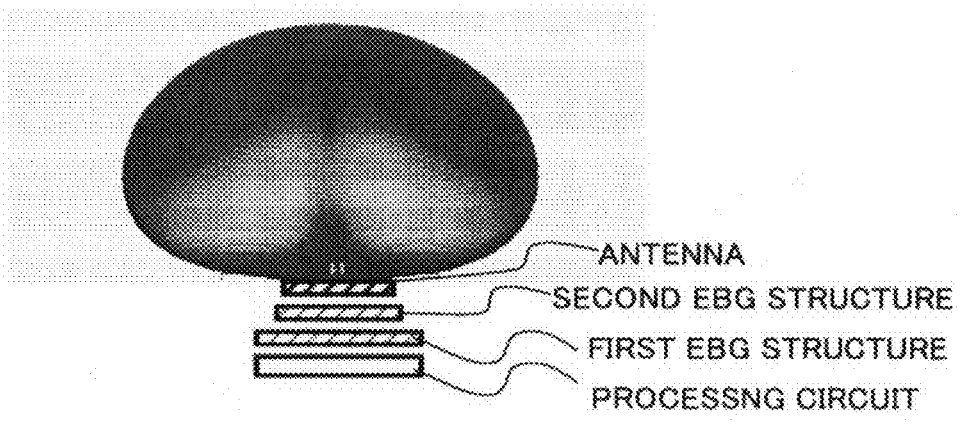
FIG. 3A and FIG. 3B are the results of a three-dimensional electromagnetic field simulation.
Figure 3B:
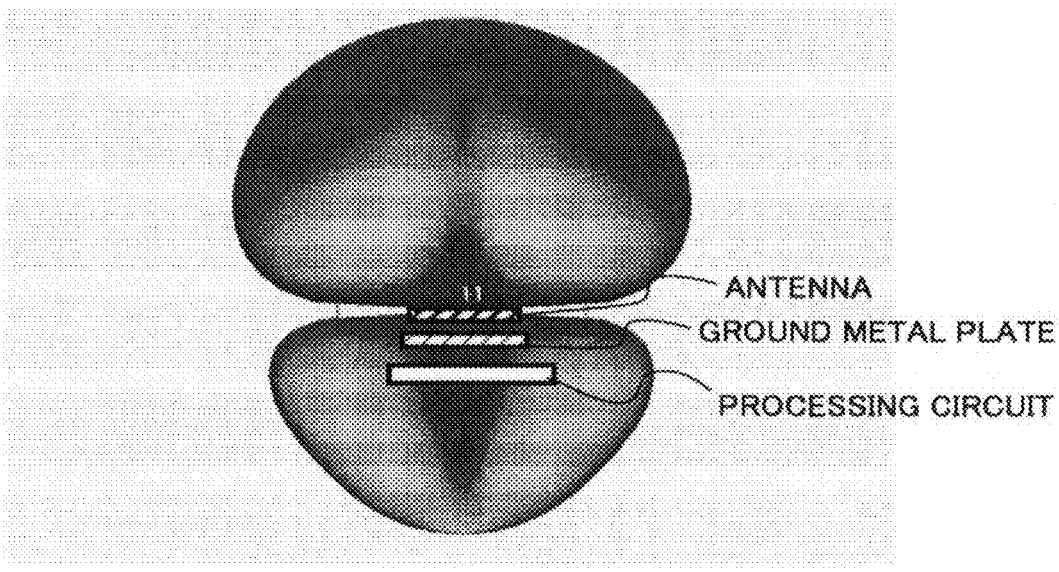

FIG. 3A and FIG. 3B are the results of a three-dimensional electromagnetic field simulation. FIG. 3A is the present embodiment, and FIG. 3B is a comparative embodiment in which a ground metal plate is provided instead of the EBG structures. FIG. 3A and FIG. 3B each show the radiation patterns of electromagnetic waves radiated from the antenna.

As shown in FIG. 3A, in the case of the present embodiment, it is understood that, by employing the first and second EBG structures, the radiation pattern of the electromagnetic field is blocked and does not spread to the signal processing circuit below the antenna. The amount of electromagnetic waves blocked at the signal processing circuit is −53 dBi, and it is understood that there is almost no effect from the electromagnetic waves radiated from the antenna.

On the other hand, as shown in FIG. 3B, in the case of the comparative example, the radiation pattern of the electromagnetic field spreads to the signal processing circuit below the antenna. Thus, there is a concern that the signal processing circuit may operate in an erroneous manner because of the electromagnetic waves radiated from the antenna.

Figure 4:
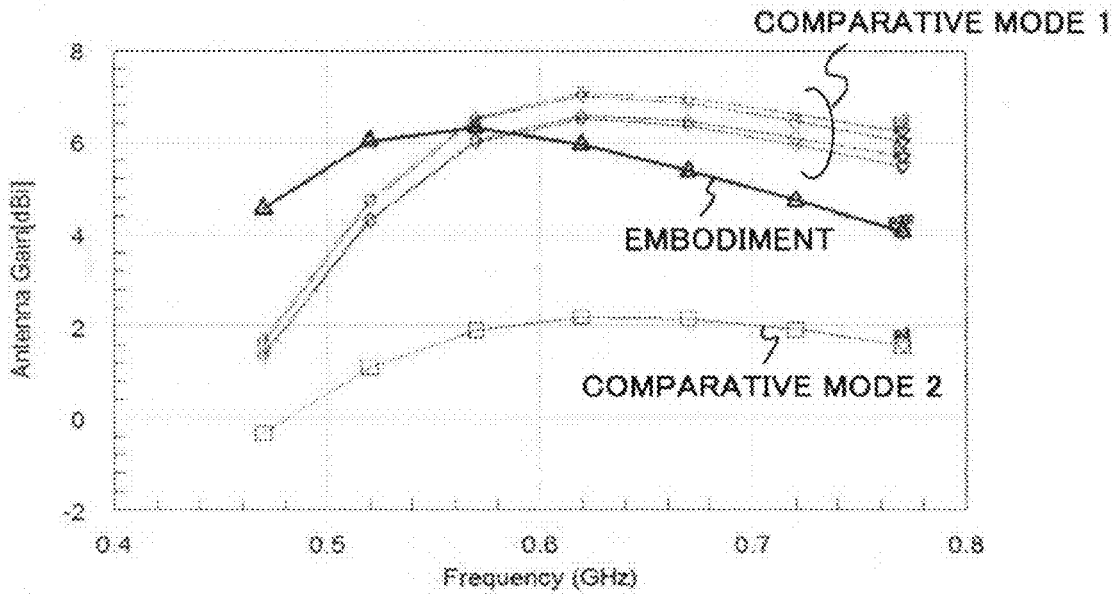
FIG. 4 is a diagram depicting the relationship between frequency and antenna gain in the first embodiment.

FIG. 4 is a diagram that shows the relationship between frequency and antenna gain in the present embodiment. An antenna device for a frequency between 470 MHz to 960 MHz used for wireless broadband is employed as an example.

Comparative Mode 1 is a mode in which a ground metal plate is provided instead of the EBG structures, and Comparative Mode 2 is a mode in which no ground metal plate is provided. It is understood that an antenna gain that is the same as that in Comparative Mode 1 is obtained also in the present embodiment.

The characteristics of blocking electromagnetic waves from the antenna can be optimized by adjusting parameters such as the shape, size, and the number of the metal patches of the second conductive layer 16, the third conductive layer 20, and the fourth conductive layer 24, and the lengths of the first via 18, the second via 22, and the third via 26.

For example, it is also possible that the second EBG structure is configured from just the third conductive layer 20 and the second via 22, and the fourth conductive layer 24 and the third via 26 are omitted. However, from the viewpoint of improving the blocking characteristics, it Is preferable for the fourth conductive layer 24 and the third via 26 to be included.

Furthermore, from the viewpoint of manufacturing the device easily, it is preferable for the third conductive layer 20 and the fourth conductive layer 24 to be disposed substantially on the same plane.

Furthermore, for example, a structure may be implemented in which a semiconductor device is provided on a different level from the semiconductor devices 12*a*, 12*b*, 12*c*, and 12*d*, and signal processing circuits are stacked in two or more layers.

According to the antenna device 100 of the present embodiment, by providing the first and second EBG structures, the electromagnetic field radiated by the antenna 30 is blocked from radiating downward toward a signal processing circuit. Thus, even if the signal processing circuit and the antenna 30 are mounted together in close proximity, stable operation of the signal processing circuit is realized. Furthermore, due to the simple and small EBG structure in which the conductive layers and the vias are used, it becomes possible to block the electromagnetic field radiated by the antenna 30.

(Second Embodiment)

The antenna device of the present embodiment is the same as in the first embodiment except that an opening through which a via does not pass is provided in the second conductive layer. Thus, descriptions that overlap those of the first embodiment are omitted.

Figure 5:
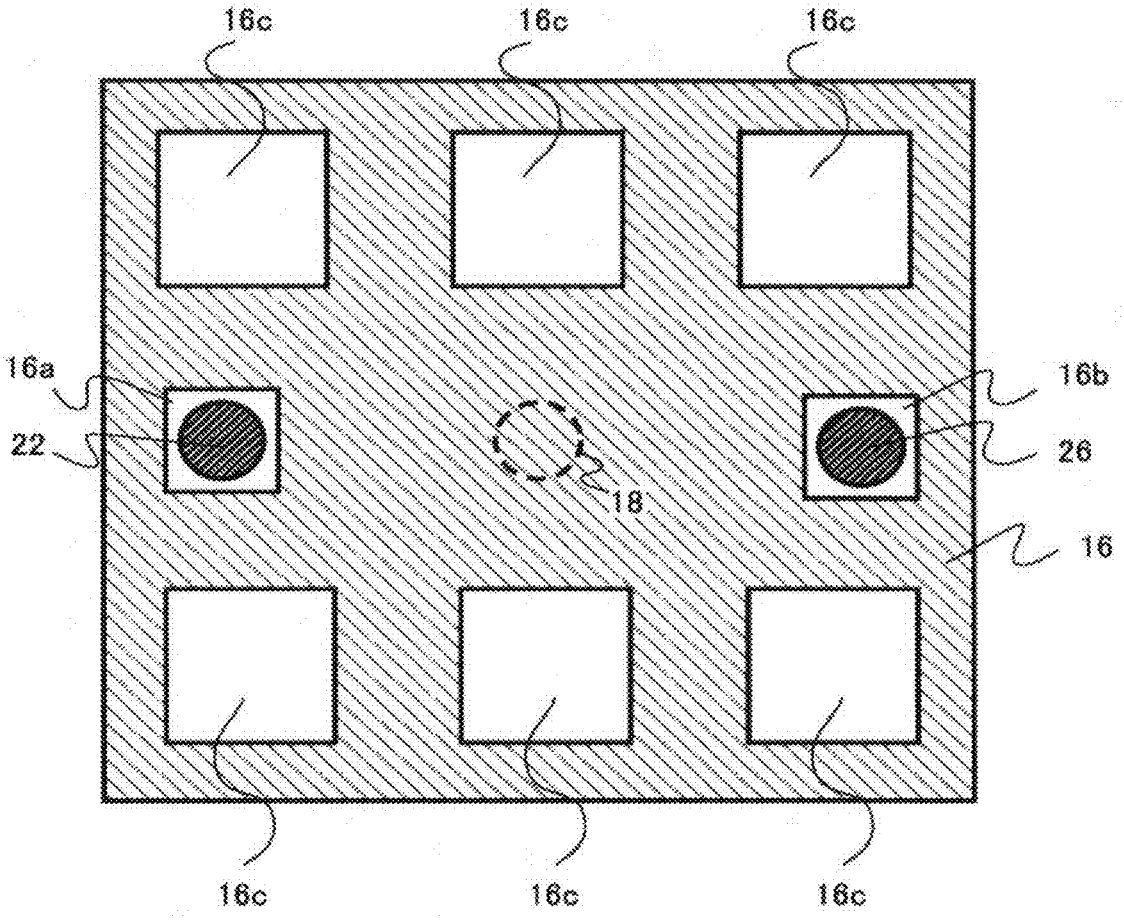
FIG. 5 is a top view depicting the pattern of a second conductive layer of a second embodiment.

FIG. 5 is a top view depicting the pattern of a second conductive layer 16 of the second embodiment. As in the first embodiment, a first opening 16*a* through which a first via 22 passes, and a second opening 16*b* through which a second via 26 passes are provided in the second conductive layer 16.

A third opening 16*c* through which a via does not pass is additionally provided. The third opening 16*c* has a rectangular shape.

According to the present embodiment, by providing the third opening 16*c*, the area of the second conductive layer 16 changes. Thus, it becomes possible that the capacitance component of the first EBG structure is changed. It consequently becomes possible to also adjust the characteristics regarding blocking electromagnetic waves from the antenna 30, with a high degree of precision.

The shape of the third opening 16*c* is not restricted to a rectangular shape as long as it is possible for the capacitance component of the first EBG structure to be changed.

(Third Embodiment)

The antenna device of the present embodiment is the same as in the second embodiment except that the shape of the third opening 16*c* is a bent shape. Thus, descriptions that overlap those of the second embodiment are omitted.

Figure 6:
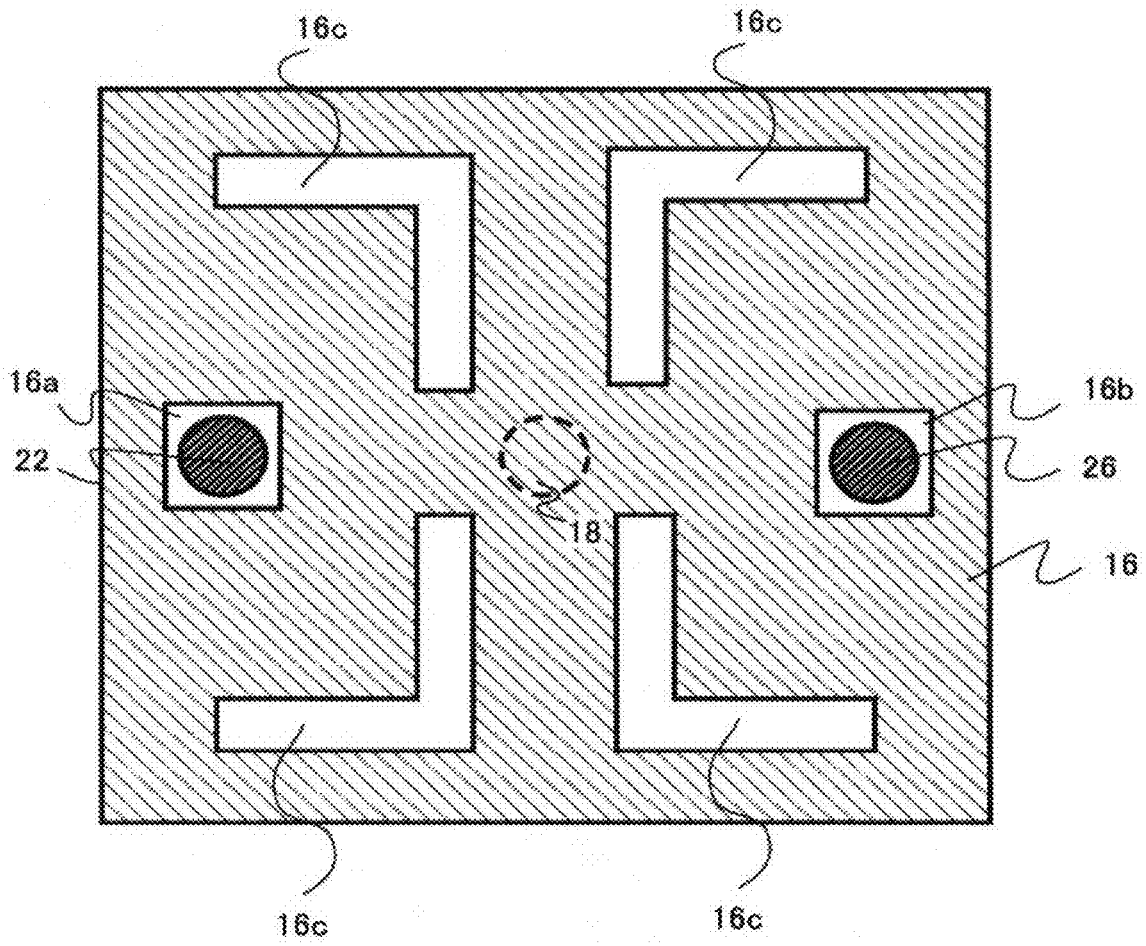
FIG. 6 is a top view depicting the pattern of a second conductive layer of a third embodiment.

FIG. 6 is a top view depicting the pattern of a second conductive layer 16 of the third embodiment. As in the first embodiment, a first opening 16*a* through which a first via 22 passes, and a second opening 16*b* through which a second via 26 passes are provided in the second conductive layer 16.

A third opening 16*c* through which a via does not pass is additionally provided. The third opening 16*c* has a bent shape. A bent shape means a shape that is provided with directionality and in which that directionality changes midway in the shape. The bent shape is an L shape in the present embodiment. The bent shape is not restricted to an L shape, and, for example, may be a T shape or a zigzag shape or the like, or another kind of bent shape.

According to the present embodiment, by providing the third opening 16*c*, the route of the current that flows through the second conductive layer 16 changes and becomes longer. It consequently becomes possible to change the inductance component of the first EBG structure. It therefore becomes possible to adjust the characteristics regarding blocking electromagnetic waves from the antenna 30, with a high degree of precision. In this case, it is possible to suppress the decrease in the area of the second conductive layer 16 caused by providing an opening, and thus it is possible to suppress the change in the capacitance component.

The shape of the third opening 16*c* is not restricted to a bent shape as long as it is possible for the inductance component of the first EBG structure to be changed.

Furthermore, it is possible for both the inductance component and the capacitance component to be adjusted by combining with a rectangular shaped opening as indicated in the second embodiment.

While certain embodiments have been described, these embodiments have been presented by way of example only, and are not intended to limit the scope of the inventions. Indeed, the antenna device described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. An antenna device comprising:

a first conductive layer connected to a ground potential;

a first semiconductor device provided above the first conductive layer;

a second semiconductor device provided above the first conductive layer;

a second conductive layer provided above the first semiconductor device and the second semiconductor device, a dielectric provided between the second conductive layer and the first semiconductor device and between the second conductive layer and the second semiconductor device, the second conductive layer including a first opening;

a first via interposed in between the first semiconductor device and the second semiconductor device, the first via being spaced from the first semiconductor device and from the second semiconductor device, and the first via connecting the second conductive layer and the first conductive layer;

a third conductive layer provided above the second conductive layer, the dielectric provided between the third conductive layer and the second conductive layer;

a second via passing through the first opening, the second via connecting the third conductive layer and the first conductive layer; and an antenna provided above the third conductive layer, the first semiconductor device disposed between the first conductive layer and the antenna, the second semiconductor device disposed between the first conductive layer and the antenna, the dielectric provided between the antenna and the third conductive layer.

2. The antenna device according to claim 1, further comprising:

a fourth conductive layer provided above the second conductive layer, the dielectric provided between the fourth conductive layer and the second conductive layer; and a third via connecting the fourth conductive layer and the first conductive layer, wherein the second conductive layer has a second opening, and the third via does not pass through the second opening.

3. The antenna device according to claim 2, wherein the third conductive layer and the fourth conductive layer are substantially on the same plane.

4. The antenna device according to claim 1, wherein the second conductive layer has a third opening, and a via does not pass through the third opening.

5. The antenna device according to claim 1, wherein the first, second, and third conductive layers are a metal.

6. The antenna device according to claim 1, wherein the dielectric is a resin.

7. The antenna device according to claim 1, wherein the first and second vias are a metal.

8. The antenna device according to claim 4, wherein the third opening has a rectangular shape.

9. The antenna device according to claim 4, wherein the third opening has a bent shape.

10. The antenna device according to claim 1, further comprising a fifth conductive layer electrically connected to the first semiconductor device, the fifth conductive layer provided between the first conductive layer and the second conductive layer.

* * * * *